US006769416B2

(12) United States Patent
Itou et al.

(10) Patent No.: US 6,769,416 B2
(45) Date of Patent: Aug. 3, 2004

(54) EVAPORATED FUEL PROCESSING MODULE

(75) Inventors: Takayuki Itou, Tokyo (JP); Takashi Sugimoto, Aichi (JP); Kenji Suzuki, Aichi (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/311,231

(22) PCT Filed: May 11, 2001

(86) PCT No.: PCT/JP01/03958

§ 371 (c)(1),
(2), (4) Date: Dec. 17, 2002

(87) PCT Pub. No.: WO02/092989

PCT Pub. Date: Nov. 21, 2002

(65) Prior Publication Data

US 2003/0089345 A1 May 15, 2003

(51) Int. Cl.[7] ..... F02M 33/02
(52) U.S. Cl. ..... 123/519; 123/518
(58) Field of Search ..... 123/519, 518, 123/520, 198 D; 251/129.15

(56) References Cited

U.S. PATENT DOCUMENTS

| | | | | |
|---|---|---|---|---|
| 5,148,793 A | * | 9/1992 | Reddy | 123/520 |
| 5,429,099 A | | 7/1995 | DeLand | |
| 5,560,347 A | * | 10/1996 | Reddy et al. | 123/520 |
| 5,599,384 A | * | 2/1997 | Yoshida et al. | 96/143 |
| 5,727,532 A | | 3/1998 | Everingham et al. | |
| 5,875,765 A | * | 3/1999 | Norton | 123/520 |

FOREIGN PATENT DOCUMENTS

| | | |
|---|---|---|
| DE | 199 25 677 A1 | 4/1999 |
| JP | 60-152057 | 10/1985 |
| JP | 05-17413 | 5/1993 |
| JP | 06-122364 | 5/1994 |
| JP | 09-025857 | 1/1997 |
| JP | 11-182361 | 7/1999 |
| JP | 11-280569 | 10/1999 |

* cited by examiner

*Primary Examiner*—Mahmoud Gimie
(74) *Attorney, Agent, or Firm*—Sughrue Mion, PLLC

(57) ABSTRACT

An evaporated fuel treating module 20 is an integration of a canister 5, a pressure sensor 6, a canister vent solenoid valve 7, an air filter 8 and a one way-valve 9 into a unit without connecting pipes. Further, in the evaporated fuel treating module 20, also a two-way valve 10 and a bypass solenoid valve 12 may be integrated into the unit.

11 Claims, 13 Drawing Sheets

EVAPORATED FUEL PROCESSING MODULE

BACKGROUND OF THE INVENTION

1. Field of the Invention

The present invention relates to an evaporated fuel treating module that absorbs and treats evaporated fuel from a fuel tank and the like of a vehicle to prevent the evaporated fuel from being discharged into the atmosphere.

2. Background Art

It has been known that volume of the evaporated fuel from a fuel system such as a fuel tank, a carburetor and the like increases with rising of temperature. In particular, immediately after a vehicle stops, because the temperature in a fuel tank is being risen and an evaporation of fuel becomes active, so that it is necessary to provide an evaporated fuel treating system having a function of temporarily storing the evaporated fuel.

FIG. 1 is a block diagram to show a configuration of the evaporated fuel treating system in the prior art. In FIG. 1, a reference numeral 1 denotes a fuel tank and a reference numeral 2 denotes a connection pipe for connecting an intake manifold 3 of an engine (not shown) to the fuel tank 1 via a purge solenoid valve 4. The connection pipe 2 is a connection pipe for supplying the evaporated fuel generated from the fuel tank 1 to the engine (not shown) and has, at some midpoint thereof, a canister 5 filled with some amount of absorbent (activated carbon or the like) for absorbing the evaporated fuel generated from the fuel tank 1 and the like. To the canister 5 are connected a pressure sensor 6 that measures the pressure of the whole connection pipe 2 and a canister vent solenoid valve 7 that is usually open and, when a leak check of an evaporation system is made, is closed to introduce a negative pressure from the intake manifold 3 and to keep the negative pressure. To the canister vent solenoid valve 7 are connected an air filer 8 for removing dust in the atmosphere supplied to the intake manifold 3 side which is at a negative pressure during operation and a one-way valve 9 that when the canister 5 side is at a positive pressure, is opened to discharge air passing through the canister 5 and stripped of the evaporated fuel and is closed when the canister 5 side is at a negative pressure.

Further, at a midpoint of the connection pipe 2 between the canister 5 and the fuel tank 1, is provided a two-way valve 10, and a branch pipe 11 bypassing the two-way valve 10 is provided with a bypass solenoid valve 12. In a case where the fuel tank 1 side is controlled at a slightly more positive pressure than the canister 5 side to prevent the evaporated fuel from being generated from the fuel tank 1, when the fuel tank 1 side is made at the slightly more positive pressure, the two-way valve 10 is closed to keep the pressure, and when the fuel tank 1 side is made at a negative pressure or a greatly more positive pressure as compared with the canister 5 side, that is, the atmosphere side, the two-way valve 10 is opened to return the pressure in the fuel tank 1 side to the atmosphere side. The bypass solenoid valve 12 is usually closed and, when the leak check described above is made, is opened irrespective of the state of the two-way valve 10. This is because of the following reason: when a leak check of the connection pipe 2 is made, in the case where the two-way valve 10 is closed, the range of the connection pipe 2 subjected to the leak check is limited to the connection pipe 2 between the canister 5 and the intake manifold 3, so that, to avoid this, the bypass solenoid valve 12 is opened to expand the range of the connection pipe 2 subjected to the leak check to the whole range of the connection pipe 2 and the fuel tank 1.

Further, the fuel tank 1 is provided with an inlet pipe 13 for adding the fuel and the opening portion of the inlet pipe 13 is removably mounted with a cup 14. In addition, a leveling valve 15 is provided at one end of the connection pipe 2 and the connection pipe 2 is provided with a liquid separator 16 for preventing the liquid fuel from moving from the fuel tank 1 to the canister 5 side via the connection pipe 2.

Next, an operation will be described.

First, when the engine (not shown) is started, a negative pressure is generated in the intake manifold 3 of the engine (not shown). During the operation of the engine (not shown), the atmosphere introduced through the air filter 8 separates the evaporated fuel absorbed and held by the absorbent (activated carbon or the like) in the canister 5 to clean the absorbent (activated carbon or the like) and supplies the evaporated fuel to the intake manifold 3 side of the engine (not shown).

Next, immediately after the engine (not shown) is stopped, the temperature in the fuel tank 1 remains high and thus the fuel actively evaporates and the evaporated fuel is temporarily absorbed and held by the absorbent (activated carbon or the like) in the canister 5.

Next, when the leak check is made, the engine is in a state of operation and the intake manifold 3 is at a negative pressure, and thus the canister vent solenoid valve 7 arranged on the atmosphere side of the canister 5 is closed and the purge solenoid valve 4 is opened for a predetermined time to introduce the negative pressure from the intake manifold 3 side and to keep the negative pressure. At this time, the bypass solenoid valve 12 is opened to make the connection pipe 2 communicate through the whole portion to reduce the whole communication pipe 2 to the negative pressure. In a case where the negative pressure is kept it is decided that a leak does not occur, but when the pressure increases it is decided that the leak does occur at some point of the whole closed system.

However, in the evaporated fuel treating system in the prior art, all the parts of the canister 5 as a main part, the pressure sensor 6, the canister vent solenoid valve 7, the air filter 8 and the one-way valve 9 are connected to each other with the pipes, so that mounting the respective parts inevitably requires a work of connecting pipes and hence presents a problem of requiring a large amount of manpower.

Further, the evaporated fuel treating system in the prior art presents a problem that there are many pipe connection portions and that the connection portions are easily separated when a vehicle is broken in an accident.

Still further, the evaporated fuel treating system in the prior art presents a problem that the evaporated fuel adheres to the inside of a rubber parts for connecting the respective parts described above to the pipes and passes bit by bit through the portions from the inside to the outside.

Still further, the evaporated fuel treating system in the prior art presents a problem that a metal portion as a magnetic path of the solenoid valve used as a part easily rusts when it is covered with, for example, an snow melting agent such as calcium chloride scattered while the vehicle is running.

The present invention has been made to solve the problems described above. The object of the present invention is to provide an evaporated fuel treating module that simplifies a work of mounting parts, improves reliability, prevents fuel from passing through connection portions and prevents the metal portions of the parts from rusting.

In this respect, such an evaporated fuel treating system is disclosed, in, for example, Laid open Japanese Patent Publication Hei 09-25857 and Japanese Utility Model Publication Hei 05-17413, but both the evaporated fuel treating systems disclosed in the above Publications can not solve the foregoing problems at the same time.

SUMMARY OF THE INVENTION

In an evaporated fuel treating module in accordance with the present invention, a canister vent solenoid valve is received in a first box-shaped space arranged adjacent to a canister on the atmosphere side of the canister; an air filter is received in a second box-shaped space arranged adjacent to the first box-shaped space and the canister; the canister is made to communicate with the first box-shaped space by opening portions formed in their respective wall portions and the first box-shaped space is made to communicate with the second box-shaped space by opening portions formed in their respective wall portions; and a one-way valve is fixed to a cover of the first box-shaped space. Since this configuration makes it possible to finish mounting work only by mounting the module described above on a vehicle, it is possible to simplify the work of mounting the respective parts on the vehicle. Further, since this configuration can eliminate the work of connecting pipes, it is possible to fundamentally prevent the problem in the prior art, that is, to fundamentally prevent the evaporated fuel from adhering to the inside of the rubber parts for connecting the respective parts described above to the pipes and from passing little by little through the rubber parts from the inside to the atmosphere side. Still further, since the solenoid valve is received in the first box-shaped space, it is possible to surely prevent the metal parts of the canister vent solenoid valve from rusting.

In the evaporated fuel treating module in accordance with the present invention, the cover of the first box-shaped space and a power supply connector of the canister vent solenoid valve are integrally molded, wherein the canister vent solenoid valve is received in the first box-shaped space in a state a power supply terminal of the canister vent solenoid valve being protruded from the opening portion of the first box-shaped space, and the cover is mounted on the opening portion of the first box-shaped space in a state the power supply connector being connected to the power supply terminal. In this manner, it is possible to perform the work of mounting the cover on the opening portion of the first box-shaped space and the work of connecting the connector to the terminal at the same time and thus to simplify the work.

In the evaporated fuel treating module in accordance with the present invention, a gap between the power supply terminal of the canister vent solenoid valve and the power supply connector integrally molded with the cover is filled with a potting material. This can ensure the tight sealing of the first box-shaped space.

In the evaporated fuel treating module in accordance with the present invention, the power supply connector integrally molded with the cover is separated from the power supply terminal of the canister vent solenoid valve, and there is provided a connector terminal for connecting the power supply connector to the vicinity of the power supply terminal of the canister vent solenoid valve, one end of the connector terminal being electrically connected to the power supply terminal of the canister vent solenoid valve, the gap between them being filled with a potting material. This can prevent the connector terminal from interfering with the potting work and thus can improve the workability of the potting work.

In the evaporated fuel treating module in accordance with the present invention, the cover of the first box-shaped space and the canister vent solenoid valve are integrally molded. By this arrangement when a unit formed by integrally molding these parts is mounted on the first box-shaped space, it is not necessary to individually mount the respective parts such as the canister vent solenoid valve and the like, which can simplify the work.

In the evaporated fuel treating module in accordance with the present invention, the cover of the first box-shaped space communicating with the canister is integrally mounted with a pressure sensor for detecting the internal pressure of the first box-shaped space. This eliminates the need for providing pipes between the first box-shaped space and the pressure sensor and thus can simplify the mounting work.

In the evaporated fuel treating module in accordance with the present invention, the opening portion of the first box-shaped space is covered with the canister vent solenoid valve. This eliminates the need for providing a covering member for closing the opening portion of the first box-shaped space and thus can reduce the number of parts and manufacturing costs.

The evaporated fuel treating module in accordance with the present invention further includes a two-way valve disposed between the fuel tank and the canister and a bypass solenoid valve that ensures a passage between the fuel tank and the canister when the two-way valve is in a closed state, the two-way valve is received in a third box-shaped space arranged adjacent to the canister on the fuel tank side of the canister, the bypass solenoid valve is received in a fourth box-shaped space arranged adjacent to the third box-shaped space and the canister, and the canister is made to communicate with the third box-shaped space by openings formed in their wall portions and the third box-shaped space is made to communicate with the fourth box-shaped space by openings formed in their wall portions. Since this configuration makes it possible to finish mounting work only by mounting the module described above on the vehicle, it is possible to simplify the work of mounting the respective parts on the vehicle. Further, since this configuration eliminates the work of connecting pipes, it is possible to fundamentally prevent the problem in the prior art, that is, to fundamentally prevent the evaporated fuel from adhering to the inside of the rubber connection portions of the respective parts described above and the pipes and from passing little by little through the portions from the inside to the atmosphere side. Still further, since the bypass solenoid valve is received in the fourth box-shaped space, it is possible to surely prevent the metal parts of the bypass solenoid valve from rusting.

In the evaporated fuel treating module in accordance with the present invention, a cover of the fourth box-shaped space and the power supply connector of the bypass solenoid valve are integrally molded, the bypass solenoid valve is received in the fourth box-shaped space in a state the power supply terminal of the bypass solenoid valve being protruded from the opening portion of the fourth box-shaped space, and the cover is mounted on the opening portion of the fourth box-shaped space in a state the power supply connector being connected to the power supply terminal. This makes it possible to perform the work of mounting the cover on the opening portion of the fourth box-shaped space and the work of connecting the power supply connector to the power supply terminal at the time, and thus can simplify the work.

In the evaporated fuel treating module in accordance with the present invention, the third box-shaped space and the fourth box-shaped space are integrated into a space and an opening portion of the integrated space is covered with the two-way valve and the bypass solenoid valve. This eliminates the need for providing a covering member for closing the opening portion of the third box-shaped space and thus can reduce the number of parts and manufacturing costs.

In the evaporated fuel treating module in accordance with the present invention, the two-way valve and the bypass solenoid valve are integrally molded and a diaphragm for opening and closing the two-way valve is opened and closed by a magnetic drive part of the bypass solenoid valve. This can eliminate the work of mounting the respective valves and thus can simplify the mounting work and also save space.

BRIEF DESCRIPTION OF THE DRAWINGS

FIG. 6(*b*) is an illustration when viewed from a line B—B in FIG. 6(*a*).

DESCRIPTION OF THE PREFERRED EMBODIMENTS

Hereinafter to describe the present invention in more detail, the preferred embodiments in accordance with the present invention will be described below with reference to the accompanying drawings.

EMBODIMENT 1

Figure 2:
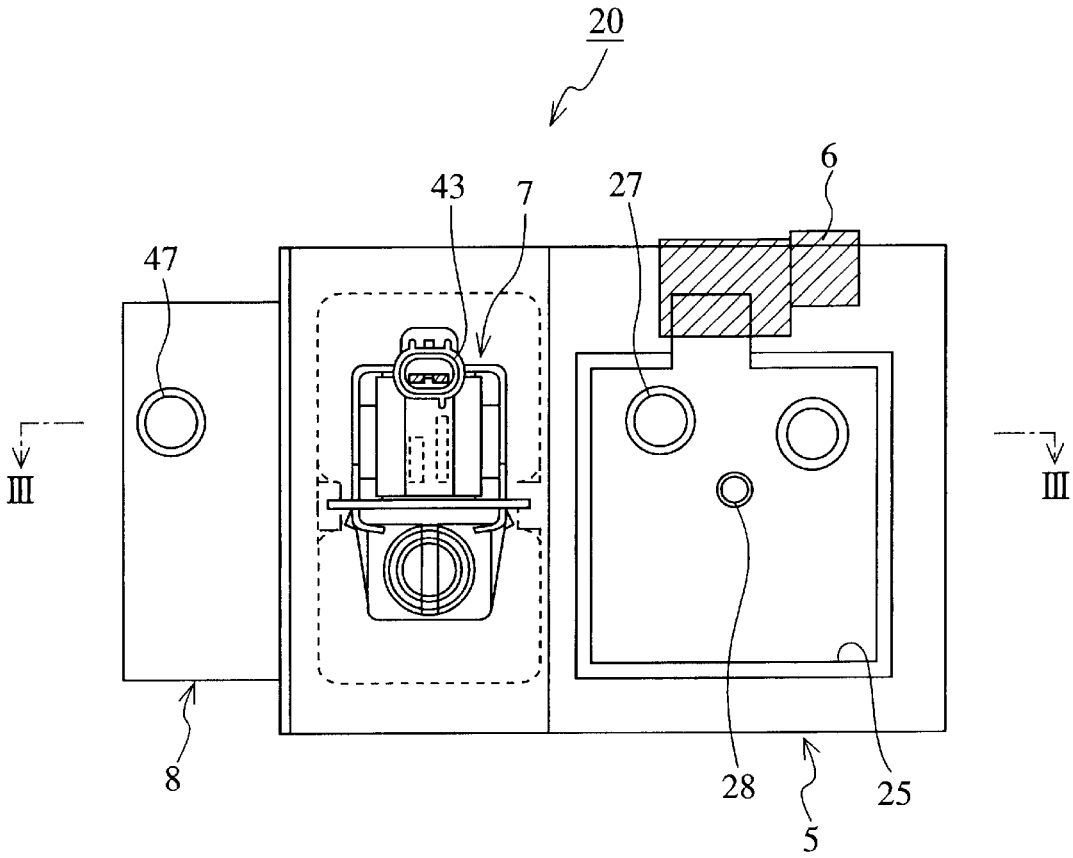
FIG. 2 is a plan view with partial transparent view to show an embodiment 1 of the evaporated fuel treating system in accordance with the present invention.
Figure 3:
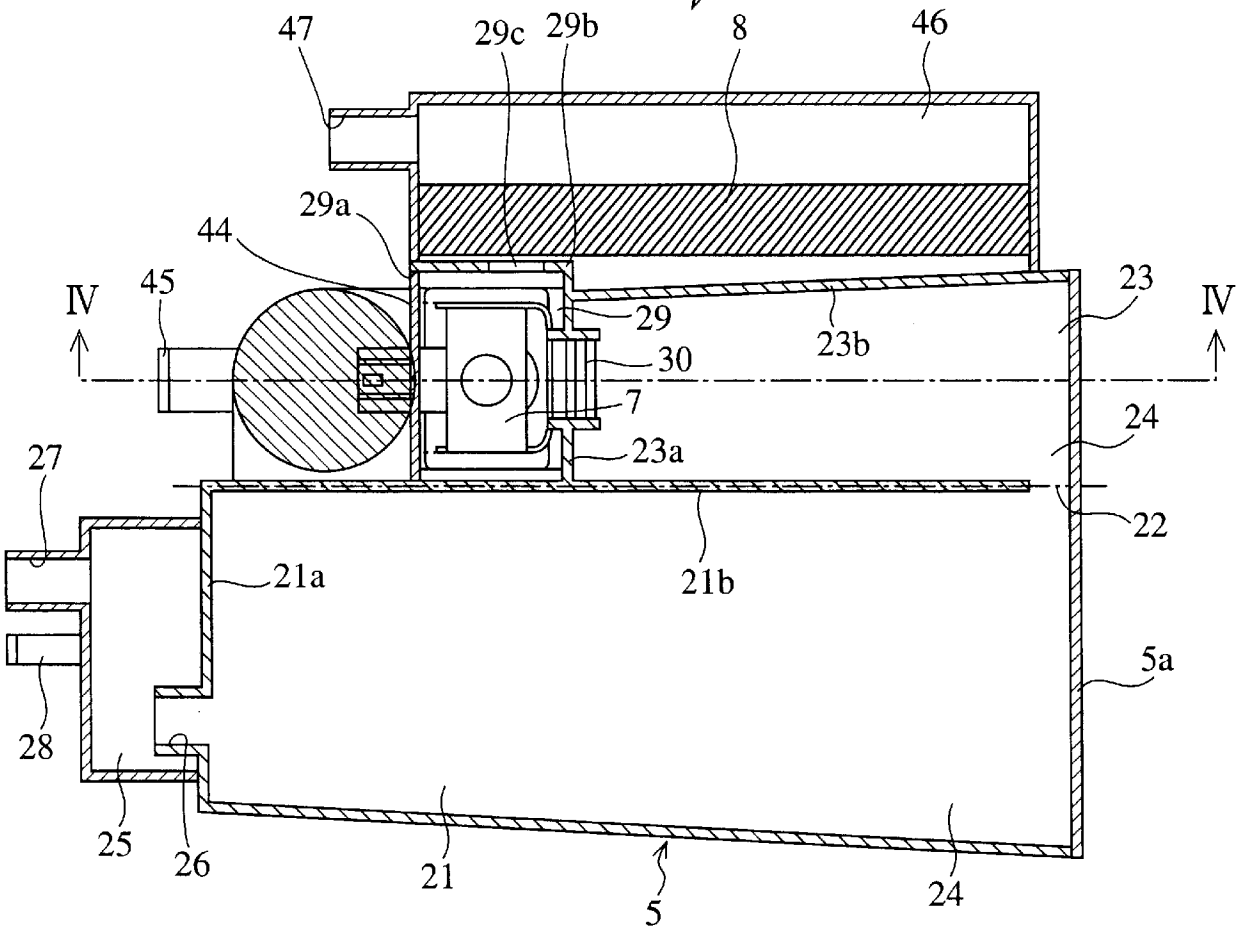
FIG. 3 is a cross-sectional view of the evaporated fuel treating system taken along a line III—III in FIG. 2.
Figure 4:
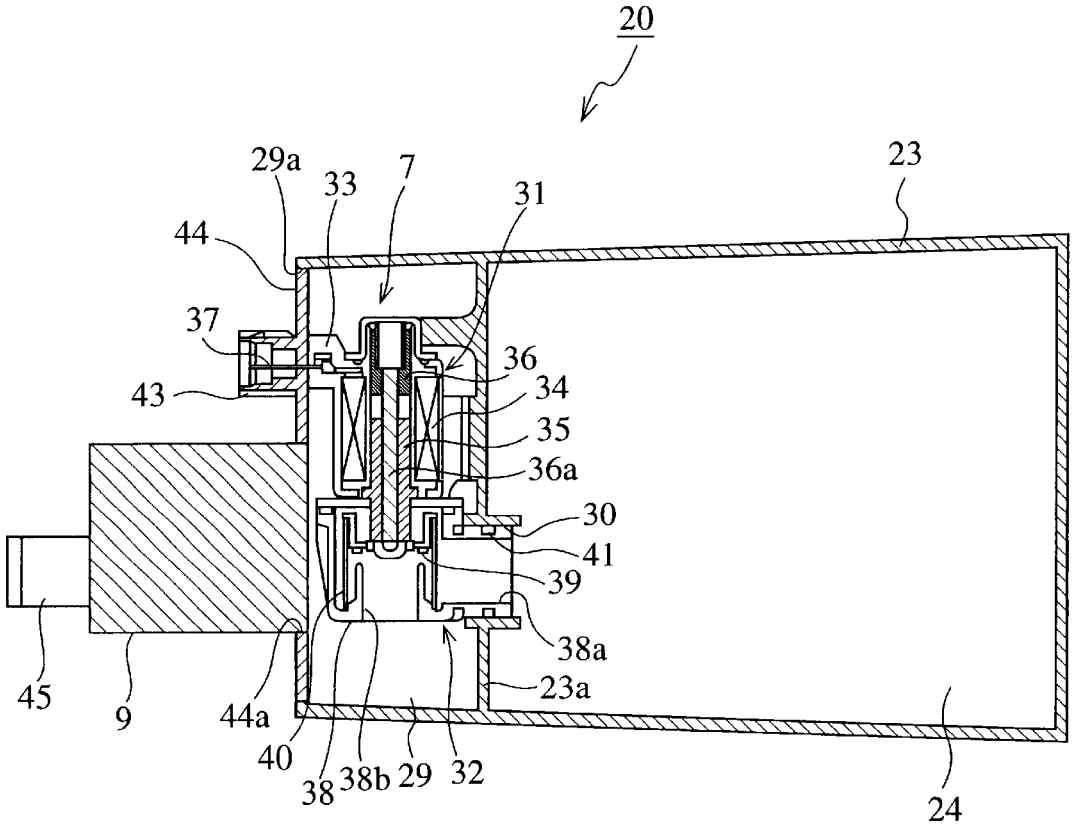
FIG. 4 is a cross-sectional view of the evaporated fuel treating system taken along a line IV—IV in FIG. 3.

FIG. 2 is a plan view with partial transparent view to show an embodiment 1 of the evaporated fuel treating system in accordance with the present invention. FIG. 3 is a cross-sectional view taken along a line III—III in FIG. 2. FIG. 4 is a cross-sectional view taken along a line IV—IV in FIG. 3. Herein, of the constituent elements of the embodiment 1, the constituents elements common to those in the evaporated fuel treating system in the prior art are denoted by the same reference numerals even if they don't have the same shapes and further description on them will be omitted.

In FIG. 2, a reference numeral 20 denotes the evaporated fuel treating module. The evaporated fuel treating module 20 is an integration of a canister 5, a pressure sensor 6, a canister vent solenoid valve 7, an air filter 8 and a one-way valve 9, which are surrounded by a broken line A in FIG. 1, into one unit without connecting pipes.

The canister 5, as shown in FIG. 3 and FIG. 4, is mainly constituted by the first container 21 of large volume, the second container 23 of small volume which communicates with the first container 21 via a gap 22 and is disposed on the atmosphere side, and an absorbent (activated carbon or the like) 24 that is packed in both the containers 21 and 23 and absorbs the evaporated fuel generated in the fuel tank 1 and the like. A front chamber 25 for receiving vapor from the fuel tank 1 is provided on the outside of the wall portion 21*a* of the first container 21 and the front chamber 25 communicates with the first container 21 through an opening portion 26. The pressure sensor 6 for detecting the pressure in the front chamber 25 is mounted on the front chamber 25, as shown in FIG. 2. That is, the pressure sensor 6 is connected to the canister 5 via the front chamber 25. Further, the front chamber 25 is provided with a connection part 27 for connecting the front chamber 25 to the connection pipe 2 on the fuel tank 1 side and a connection part 28 for connecting the front chamber 25 to the connection pipe 2 on the purge solenoid valve 4 side.

The second container 23 of the canister 5 is integrally molded on the outside of the wall portion 21*b* of the first container 21 of large volume such that the second container 23 shares a part of the wall portion 21*b* with the first container 21, and the gap 22 formed between the end of the wall portion 21*b* shared by both the containers 21 and 23 and the wall portion 5*a* of the canister 5 that is opposed to the end of the wall portion 21*b* constitutes a part of the introduction path of the evaporated fuel in the canister 5. A middle chamber (the first box-shaped space) 29 is integrally molded on the outside of the wall portion 23*a* of the second container 23, as shown in FIG. 3 and FIG. 4. The middle chamber 29 communicates with the second chamber 23 through an opening portion 30. In the middle chamber 29 is disposed the canister solenoid valve 7.

The canister vent solenoid valve 7, as shown in FIG. 4, is constituted mainly by, for example, a magnetic drive part 31 whose cover is formed of a Poly-Phenylen-Sulfide (Hereinafter it is refereed to as PPS) material and a valve body 32, and both parts are connected to each other via an O-ring (not shown). The magnetic drive part 31 is mainly constituted by a cover 33, a coil 34 wound in the cover 33, a core 35 through which a magnetic flux passes when an electric current is passed through the coil 34 and a plunger 36 which can be moved to and fro by a magnetic attractive force via a rod 36*a* supported in the core 35. The cover 33 supports a terminal 37 in such a way that the terminal 37 protrudes outside from the opening portion 29*a* of the middle chamber 29. The valve body 32 is mainly constituted by a valve seat 38 having a first opening portion 38*a* communicating with the second container 23 via the opening portion 30 and the second opening portion 38*b* communicating with the inside space of the middle chamber 29, a valve body 39 fixed to the tip of the above described plunger 36, and a spring 40 for always urging the valve body 39 in a direction in which the first opening portion 38*a* of the valve sheet 38 communicates with the second opening portion 38*b*. When the magnetic force is energized, the valve body 39 is moved against the urging force of the spring 40 to interrupt the communication between the first opening portion 38*a* and the second opening portion 38*b* of the valve seat 38. Here, a reference numeral 41 denotes an O-ring that is interposed between the communication part 29*b* of the middle chamber 29 and the first opening portion 38*a* and closes the canister 5 side when the canister vent solenoid valve 7 is closed to make the foregoing leak check.

A cover 44 integrally molded with a connector 43 for a connection of the terminal 37 described above, is fixed to the opening portion 29*a* of the middle chamber 29. As to a fixing method, in consideration of making the canister vent solenoid valve 7 disposed in the middle chamber 29 waterproof, for example, a vibration welding/bonding method or a two-layer molding method is preferably selected. Here, the gap between the terminal 37 and the connector 43 is filled with a potting material to ensure the tight sealing of the middle chamber 29.

The one-way valve 9 is integrally molded with the opening portion 44*a* of the cover 44. A reference numeral 45 denotes a discharge pipe from the one-way valve 9.

Further, a rear chamber (the second box-shaped space) 46 for receiving the air filter 8 is fixed to the outside of the wall portion 23*b* of the second container 23 and the wall portion 29*b* of the middle chamber 29, and the middle chamber 29 communicates with the rear chamber 46 through the opening portion 29*c*. A reference numeral 47 denotes an atmosphere communication pipe for introducing or discharging air passing through the air filter 8, and the air filter 8 is disposed between the atmosphere communication pipe 47 and the opening portion 29*c* of the middle chamber 29 to clean the air.

Next, an operation will be described.

First, when an engine (not shown) is started, a negative pressure is generated in the intake manifold 3 of the engine (not shown). During the operation of the engine (not shown), the atmosphere is passed by the negative pressure in the intake manifold 3 from the atmosphere communication pipe 47 of the rear chamber 46 through the air filter 8, the middle chamber 29, the second container 23, the gap 22, the first container 21 and the front chamber 25 to separate the evaporated fuel absorbed and held by the absorbent (activated carbon or the like) 24 in the canister 5, thereby cleaning the absorbent (activated carbon or the like) 24, and supplies the separated evaporated fuel to the intake manifold 3 side of the engine (not shown) from the connection part 28 via the purge solenoid valve 4.

Next, immediately after the engine (not shown) is stopped, the temperature in the fuel tank 1 remains high and the fuel actively evaporates, so the evaporated fuel is temporarily absorbed and held by the absorbent (activated carbon or the like) in the canister 5.

Next, when the leak check is made, the engine is in a state of operation and the intake manifold 3 is at negative pressure, so that the canister vent solenoid valve 7 arranged adjacent to the canister 5 without piping is closed and the purge solenoid valve 4 is opened for a predetermined time to introduce the negative pressure from the intake manifold 3 side and to keep the negative pressure. In a case where the negative pressure is kept, it is decided that a leak does not occur, but when the pressure increases it is decided that the leak does occur at some point through the whole connection pipe 2 to be closed tightly.

Figure 1:
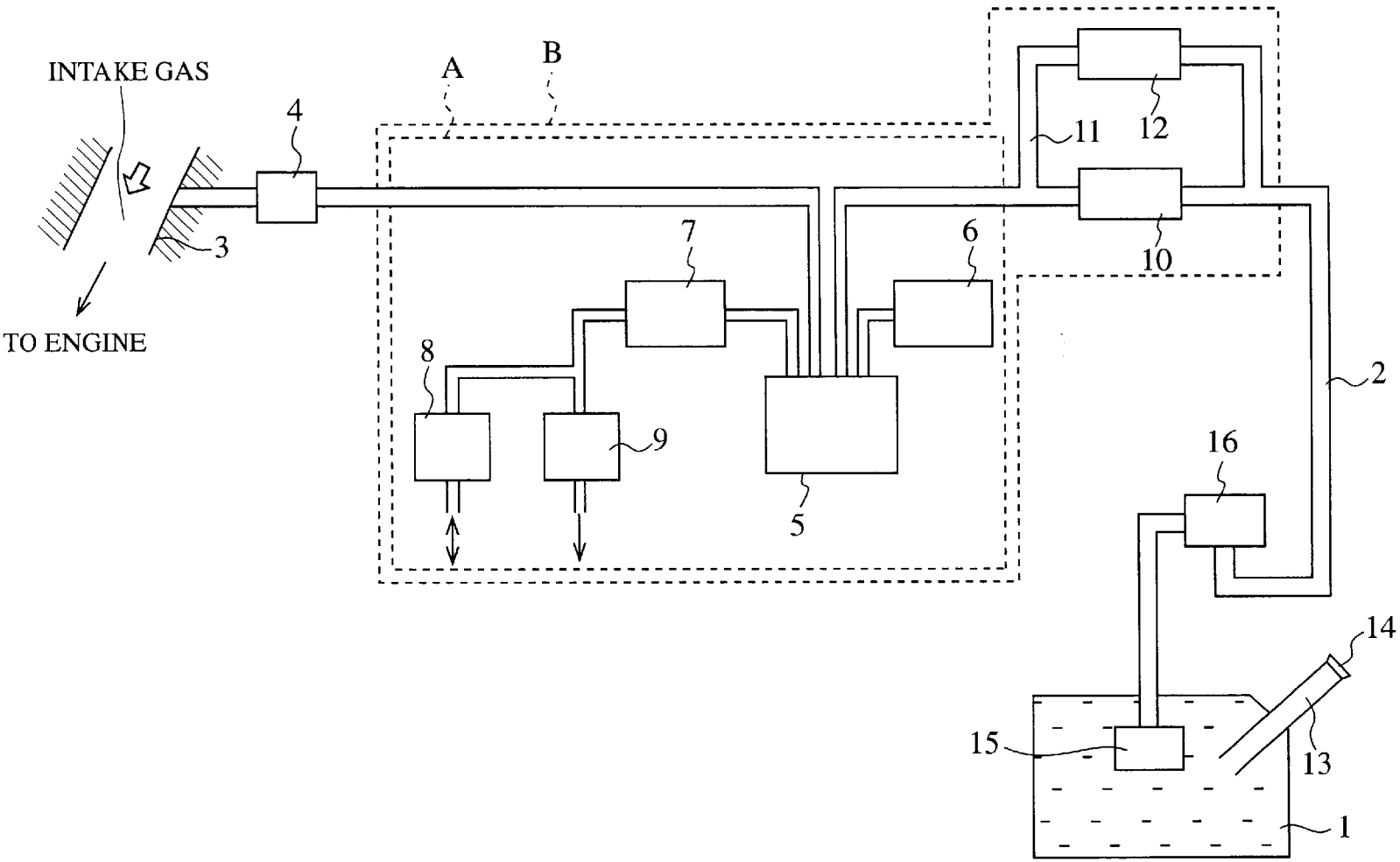
FIG. 1 is a block diagram to show a configuration of the evaporated fuel treating system in the prior art.

As described above, according to the present embodiment 1, the respective constituent elements surrounded by the broken like A in FIG. 1, that is, the canister 5, the pressure sensor 6, the canister vent solenoid valve 7, the air filter 8, an the one-way valve 9 are integrated into one module without connecting pipes, so that a mounting work can be finished only by mounting the module described above on the vehicle. Thus, it is possible to simplify the mounting work of the respective constituent elements on the vehicle and to fundamentally prevent the problem in the prior art, that is, to fundamentally prevent the evaporated fuel from adhering to the inside of the rubber parts for connecting the respective parts described above to the pipes and from passing little by little through the rubber parts from the inside to the atmosphere side.

According to the present embodiment 1, the connector 43 and the cover 44 are integrally molded, so that it is possible to perform the work of mounting the cover 44 on the opening part 29*a* of the middle chamber 29 and the work of connecting the connector 43 to the terminal 37 at the same time. This can simplify the works.

According to the present embodiment 1, the canister vent solenoid valve 7 is received in the middle chamber 29 arranged adjacent to the canister 5. Thus, this is different from the canister vent solenoid valve 7 in the prior art which is covered with the snow melting agent whirled up when the vehicle is running and hence its environmental conditions relating to rust are greatly relaxed to thereby effectively prevent the metal parts of the canister vent solenoid valve 7 from rusting. Therefore, it is essential only that the metal parts of the canister vent solenoid valve 7 are plated to such an extent that they don't rust during a manufacturing process before they are received in the middle chamber 29 and it is not necessary to subject them to an expensive plating. Thus, it is possible to reduce manufacturing costs.

According to the present embodiment 1, the whole canister vent solenoid valve 7 is formed of the PPS material having a coefficient of thermal expansion equal to the coefficient of thermal expansion of a coil wire constituting the coil 34. Thus, it is possible to prevent a break in the coil wire that occurs in the prior art and hence to reduce maintenance cost.

Modification 1 of the Embodiment 1

In FIG. 4, the terminal 37 of the canister vent solenoid valve 7 is directly inserted into the connector 43 integrally formed with the cover 44 and the connector 43 and the terminal 37 are connected to each other with a potting material, but it is also recommended that the connector 43 is connected to the terminal 37 at a portion other than the connector 43 and the portion be potted.

Figure 5:
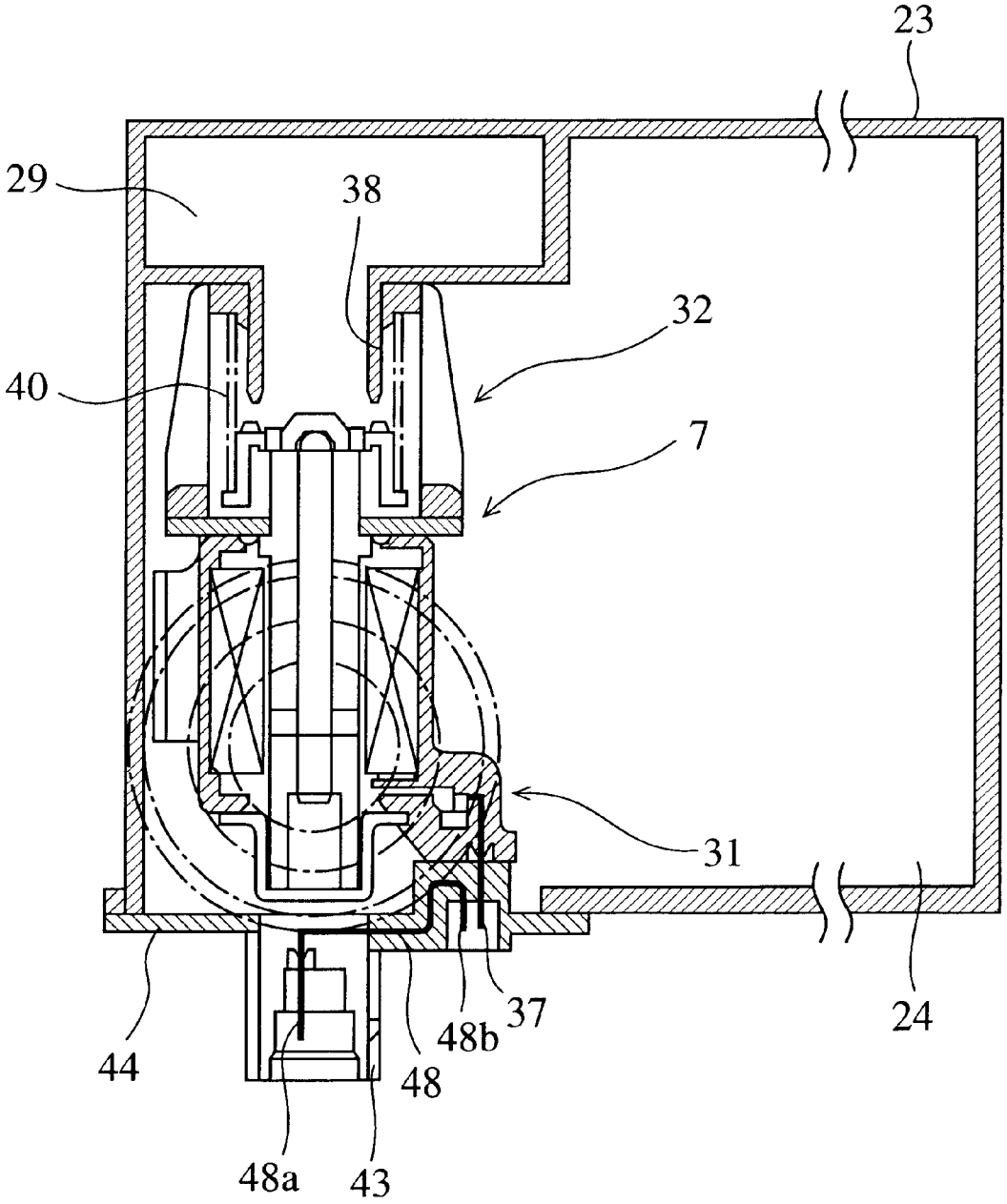
FIG. 5 is a cross-sectional view to show modifications 1 to 3 of the embodiment 1 of the evaporated fuel treating system in accordance with the present invention.

FIG. 5 is a cross-sectional view to show a part of a modification 1 of the embodiment 1 shown in FIG. 2 to FIG. 4. In FIG. 5, a reference numeral 48 denotes a connector terminal having one end 48*a* protruded into the connector 43 and the other end 48*b* extended to the vicinity of the terminal 37.

In such a constitution, the other end 48*b* of the connector terminal 48 is soldered to the terminal 37 of the canister vent solenoid valve 7 and then the portion surrounding the terminal 37 is filled with the potting material to ensure the tight sealing of the middle chamber 29. In this case, the connector terminal does not interfere with the potting work, which can improve the workability of potting.

Modification 2 of Embodiment 1

In FIG. 4, the valve seat 38 of the canister vent solenoid valve 7 is separated from the wall portion of the middle chamber 29 fixed to the second container 23 constituting the canister 5, but both of them may be integrally molded.

To be more specific, as shown in FIG. 5, by integrally molding the wall portion of the middle chamber 29 with the valve seat 38, it is possible to eliminate the use of the O-ring 41 shown in FIG. 4.

Modification 3 of the Embodiment 1

In FIG. 4 is adopted the constitution that a break in the coil wire is prevented by using PPS as a material for forming the canister vent solenoid valve 7, and also in FIG. 5 is adopted the same constitution.

Since nylon is used for the casing of the canister 5 and the air filter 8 side, for example, in the case where the cover 44 is fixed to the casing of the canister 5 by a vibration welding method, different materials reduce bonding strength and sometimes can not ensure the sufficient tight sealing of the canister 5. In the case where the tight sealing of the canister 5 has precedence, it is preferable that the cover 44 is formed of nylon that is the same material as the casing of the canister 5 side.

Modification 4 of the Embodiment 1

In FIG. 4, the terminal 37 of the canister vent solenoid valve 7 is directly inserted into the connector 43 integrally formed with the cover 44 and the connector 43 and the terminal 37 are connected to each other with the potting material, but to eliminate the potting work, it is also recommended that the canister vent solenoid valve 7, the connector 43, and the cover 44 be integrally molded.

Figure 6A:
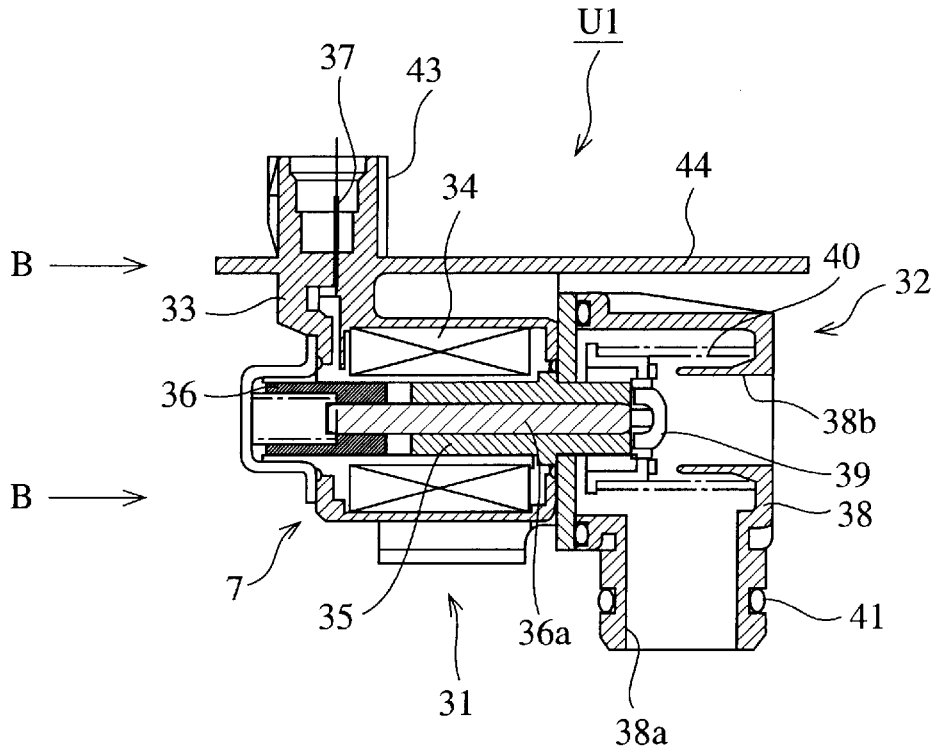
FIG. 6(*a*) is a cross-sectional view to show a modification 4 of the embodiment 1 of the evaporated fuel treating system in accordance with the present invention.
Figure 6B:
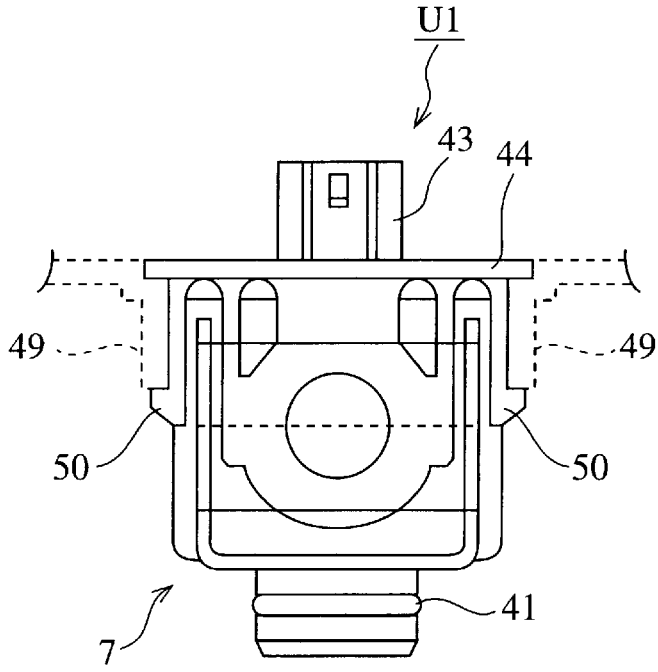

In FIG. 6(*a*) and FIG. 6(*b*) is shown a unit U1 in which the canister vent solenoid valve 7, the connector 43, and the cover 44 are integrally molded. When the unit U1 is mounted on the middle chamber 29, the work of individually mounting the canister vent solenoid valve 7 and the like is not required, so that it is possible to simplify the work. Further, as shown in FIG. 6(*b*), by providing a pair of engaged parts 49 of the canister 5 side and a pair of engaging parts 50 engaging with the end portions of these engaged parts 49 and depending from the cover 44 of the unit U1 described above, when the unit U1 is mounted on the canister 5 side, the mounting work can be simplified by a snap fit.

Modification 5 of the Embodiment 1

In FIG. 2 to FIG. 4, the pressure sensor 6 is mounted in the front chamber 25 that is at the same pressure as the canister 5, but it is also recommended that the pressure sensor 5 be mounted in the middle chamber 29 that is at the same pressure as the canister 5.

Figure 7:
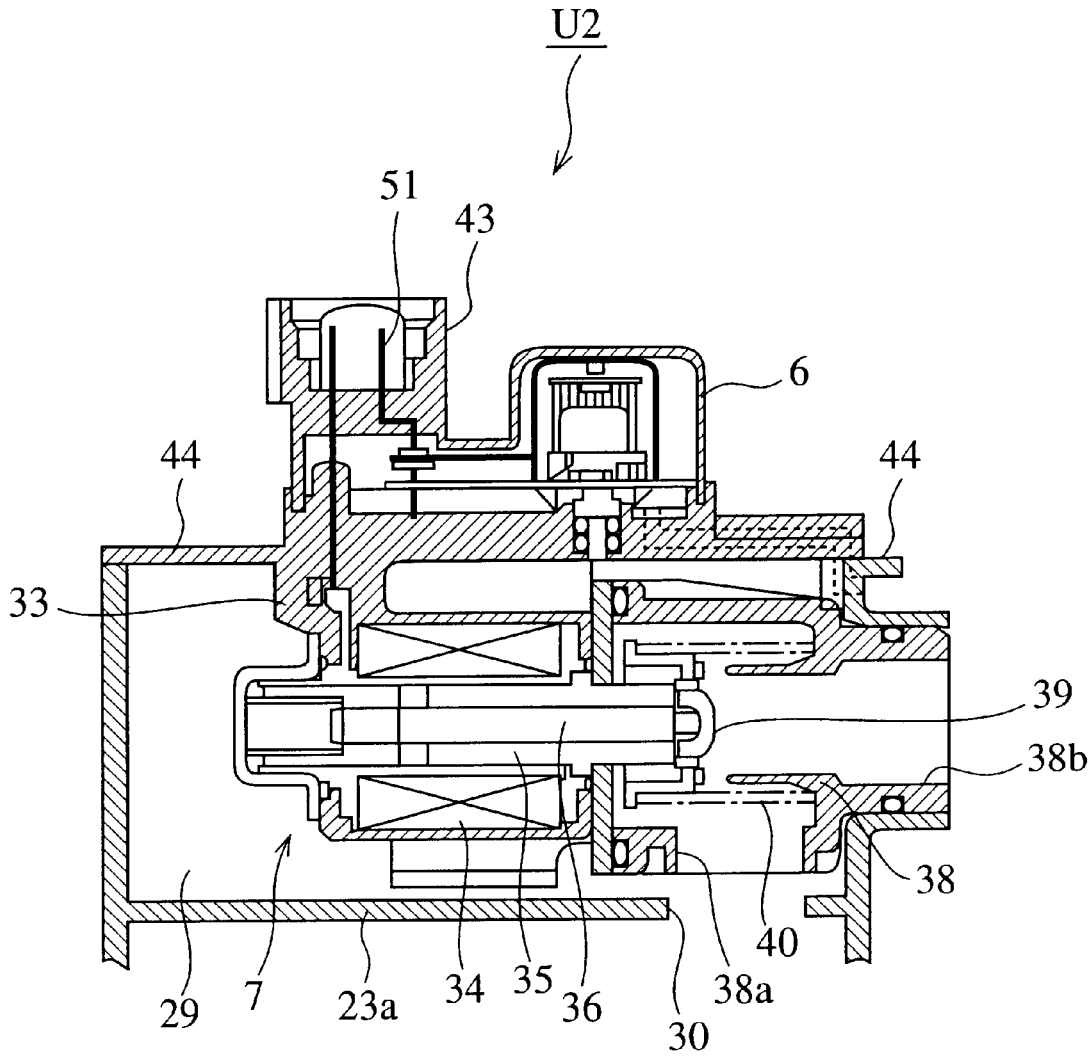
FIG. 7 is a cross-sectional view to show a modification 5 of the embodiment 1 of the evaporated fuel treating system in accordance with the present invention.

In FIG. 7 is shown a unit U2 in which the pressure sensor 6 is integrally mounted on the integrally molded canister vent solenoid valve 7, the connector 43 and the cover 44 to thereby make a unit. In the unit U2, the connector 43 and the pressure sensor 6 are mounted on the cover 44 and at the same time the canister vent solenoid valve 7 is disposed under the cover 44. The pressure sensor 6 is made to detect the pressure in the middle chamber 29 communicating with the canister 5 and integral mounting the pressure sensor 6 on the cover 44 and the like can eliminate a need for providing the piping between the middle chamber 29 and the pressure sensor 6 and thus can simplify the mounting work. The terminal 51 of the pressure sensor 6 can be connected to a power supply apparatus (not shown) via the connector 43. Therefore, utilizing the connector 43 shared by the terminal 51 of the pressure sensor 6 and the terminal 37 of the canister vent solenoid valve 7 can reduce the number of connectors and can reduce manufacturing costs.

Modification 6 of the Embodiment 1

In FIG. 2 to FIG. 4, the canister vent solenoid valve 7 is completely buried in the casing fixed to the canister 5 to prevent the metal parts of the canister vent solenoid valve 7 from rusting, but it is also recommended that the metal parts of the canister vent solenoid valve 7 be fully molded.

Figure 8:
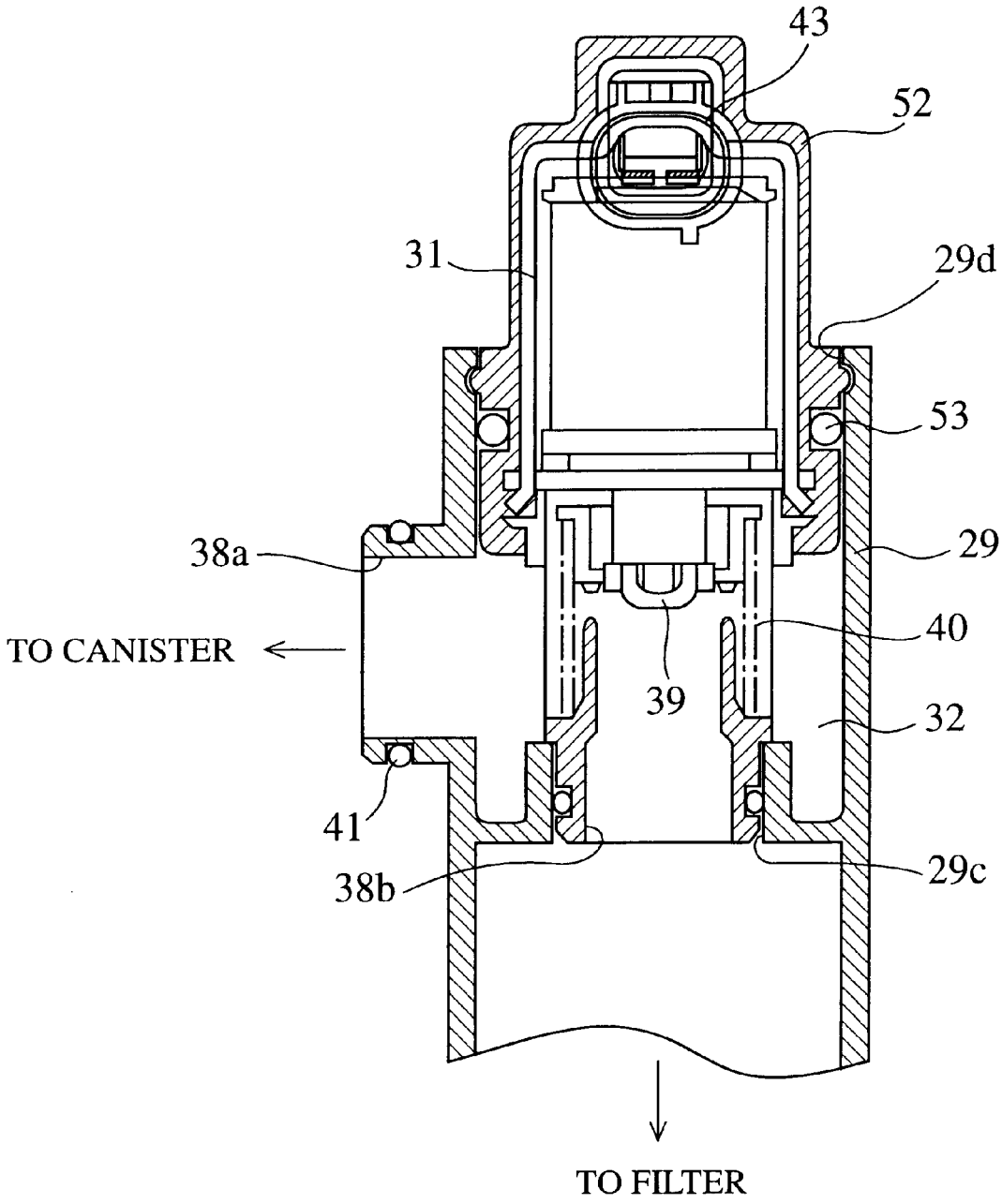
FIG. 8 is a cross-sectional view to show a modification 6 of the embodiment 1 of the evaporated fuel treating system in accordance with the present invention.

In FIG. 8 is shown the canister vent solenoid valve 7 in which the magnetic drive part 31 is fully molded. The magnetic drive part 31 covered with a full molding part 52 is exposed to the outside and the valve body 32 is buried in the middle chamber 29. Further, an O-ring 53 for ensuring the tight sealing of the middle chamber 29 is interposed between the outside of the full molding part 52 and the opening portion 29*d* of the middle chamber 29.

According to the configuration as above described, the full molding part 52 can eliminate the plating itself of the magnetic drive part 31 of the canister vent solenoid valve 7 or subject the magnetic drive part 31 to an inexpensive plating, so that it is possible to avoid or reduce the use of harmful hexavalent chrome contained in the plating.

Further, this configuration eliminates the need for providing a covering member for closing the opening portion 29*a* of the middle chamber 29, which results in reducing the number of parts and manufacturing costs.

Still further, this configuration eliminates the need for potting the connector 43, which results in simplifying the mounting work and improving maintainability.

Embodiment 2

Figure 9:
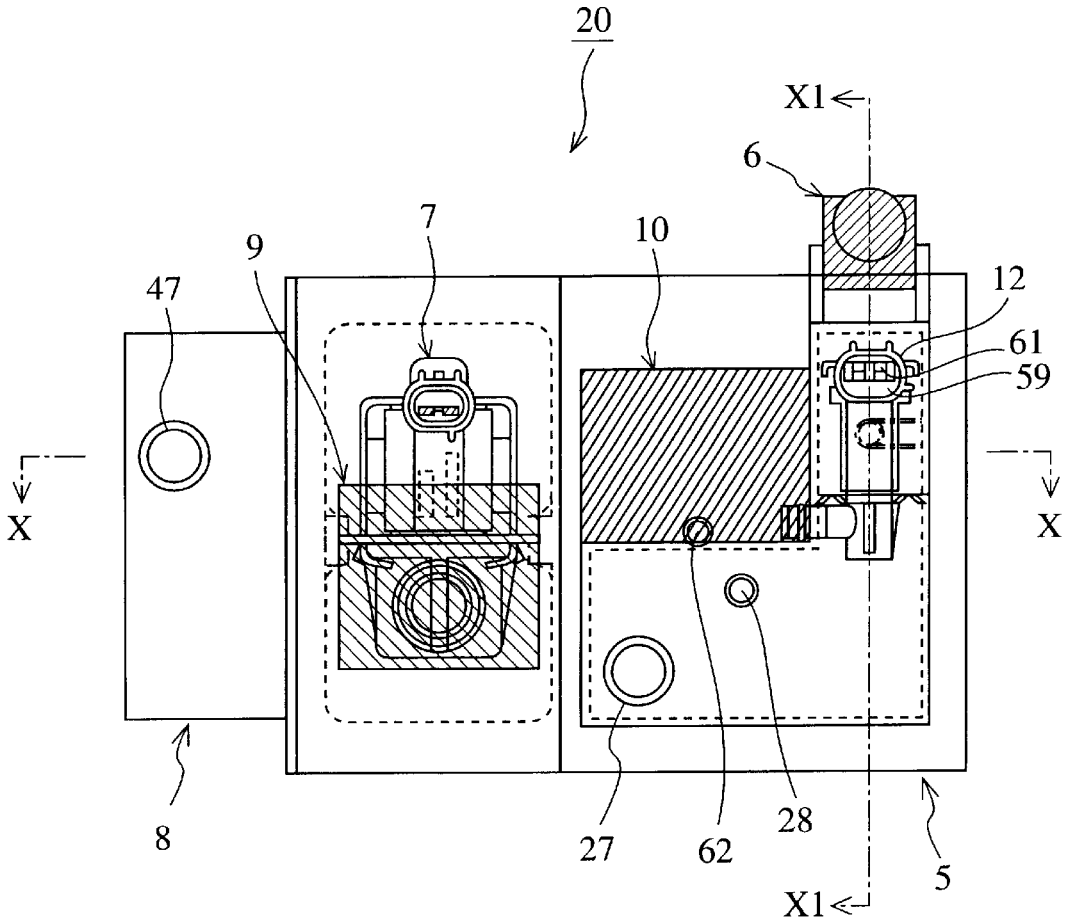
FIG. 9 is a plan view with partial transparent view to show an embodiment 2 of the evaporated fuel treating system in accordance with the present invention.
Figure 10:
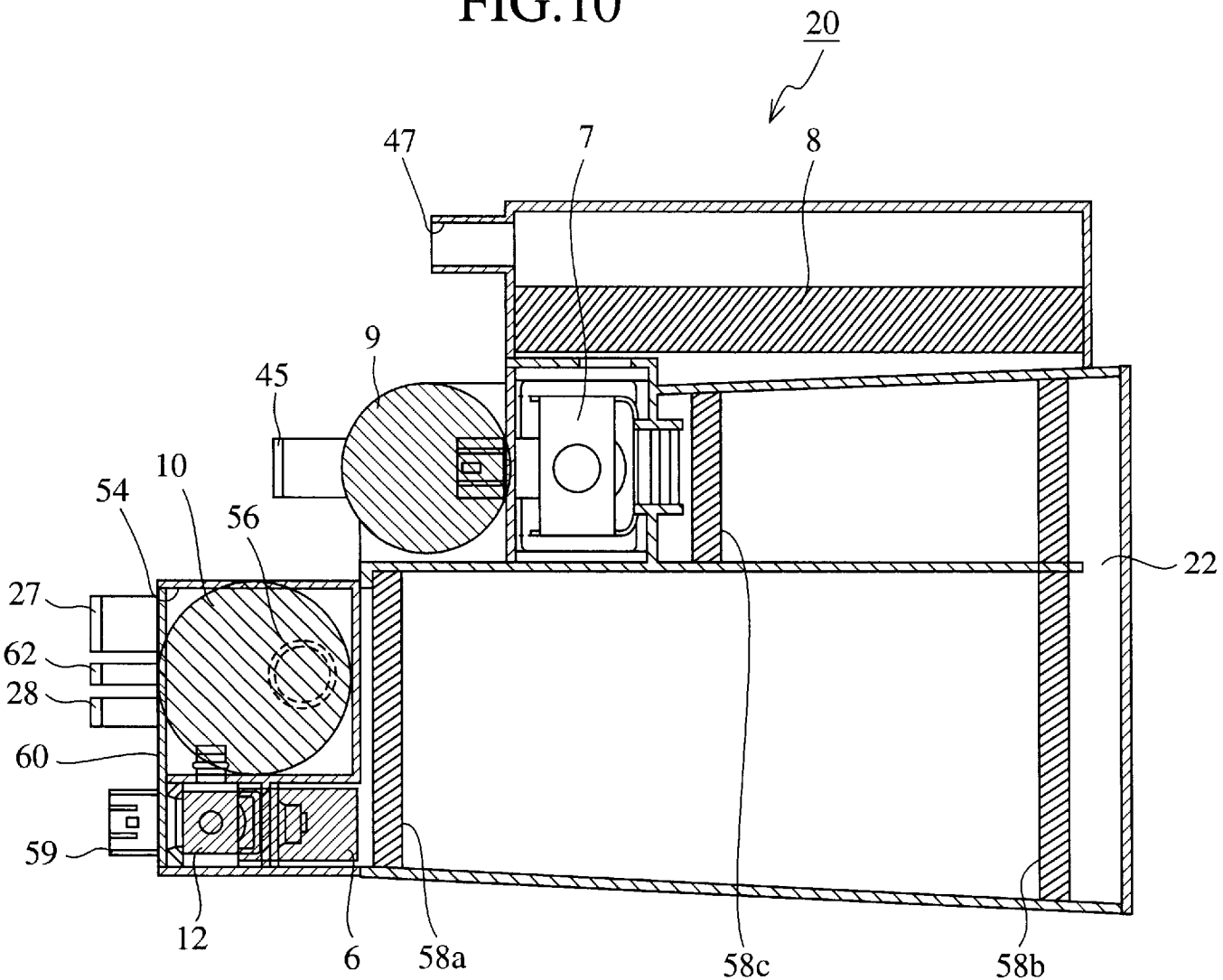
FIG. 10 is a cross-sectional view of the evaporated fuel treating system taken along a line X—X in FIG. 9.
Figure 11:
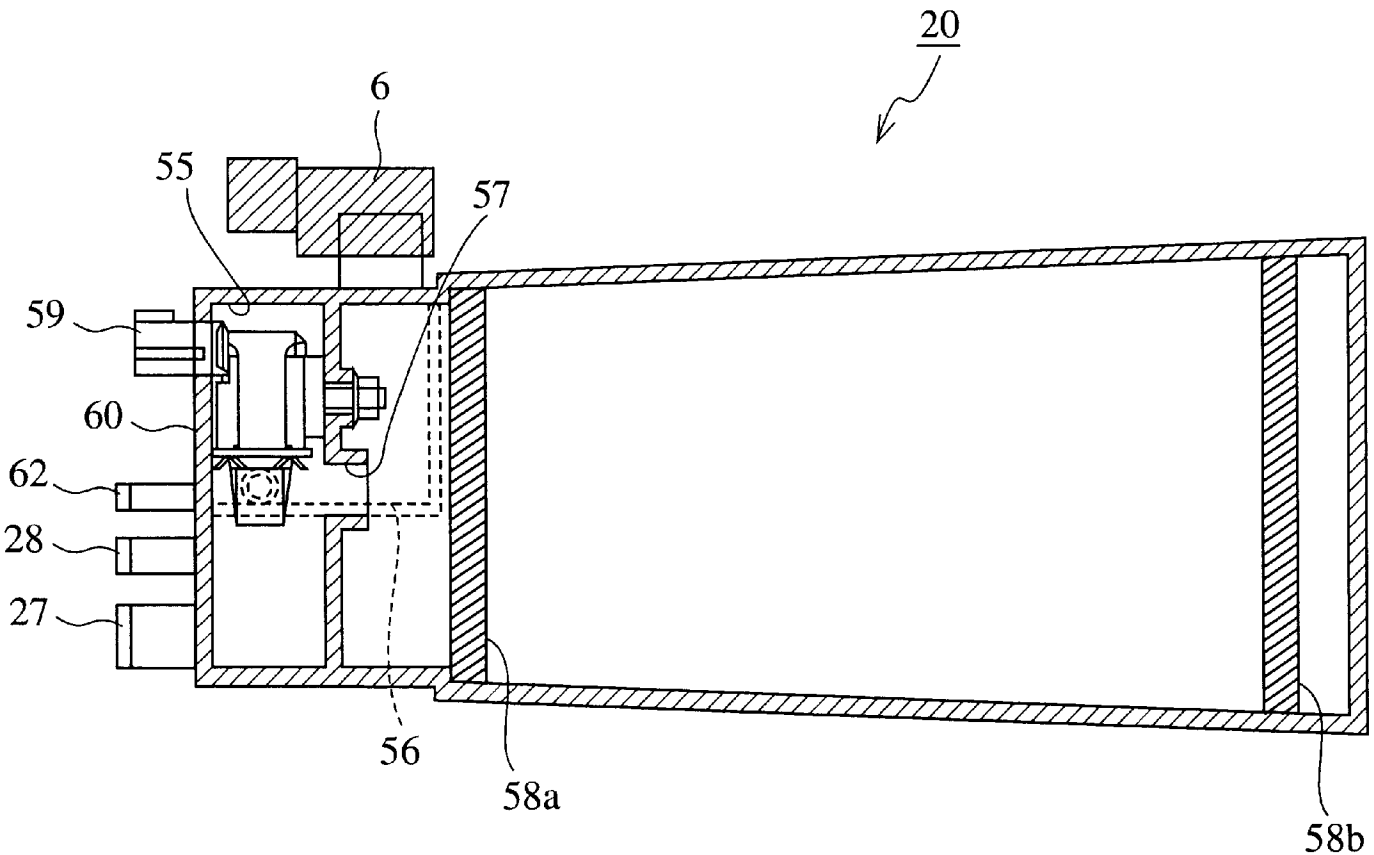
FIG. 11 is a cross-sectional view of the evaporated fuel treating system taken along a line XI—XI in FIG. 9.

FIG. 9 is a plan view with partial transparent view to show the configuration of an embodiment 2 of the evaporated fuel treating module in accordance with the present invention. FIG. 10 is a cross-sectional view taken along a line X—X in FIG. 9. FIG. 11 is a cross-sectional view taken along a line XI—XI in FIG. 9. Here, of the constituent parts of the present embodiment 2, the constituent parts common to those of the embodiment 1 are denoted by the same reference numerals and their descriptions will be omitted.

The feature of the present embodiment 2 lies in that the evaporated fuel treating module 20 described above, that is, a combination of the canister 5, the pressure sensor 6, the canister vent solenoid valve 7, the air filter 8, the one-way valve 9, the two-way valve 10 and the bypass solenoid valve 12, which are surrounded by a broken line B in FIG. 1, is integrated into one unit without connecting pipes. Here, the pressure sensor 6, as shown in FIG. 9, is disposed near the two-way valve 10.

In the drawings, a reference numeral 54 denotes the first front chamber (the third box-shaped space) arranged adjacent to the first container 21 of the canister 5 and receiving the two-way valve 10, and a reference numeral 55 denotes the second front chamber (the fourth box-shaped space) arranged adjacent to the first container 21 and receiving the bypass solenoid 5 valve 12, as is the case with the first front chamber 54. The first front chamber 54 communicates with the first container 21 through an opening portion 56 and the second front chamber 55 communicates with the first container 21 through an opening portion 57. Further, in the first container 21 and the second container 23 are disposed filters 58*a*, 58*b* and 58*c*, and the pressure sensor 6 is mounted in the space formed in the first container 21 by the filter 58. A reference numeral 59 denotes a connector for supplying electric power to the bypass solenoid valve 12 and the connector 59 is molded integrally with a cover 60 for covering the opening portion 56 of the first front chamber 54 and the opening portion 57 of the second front chamber 55. In addition, a terminal 61 for supplying electric power of the bypass solenoid valve 12 is protruded from the front chamber 55 and can be inserted into the connector 59 when the cover 60 is mounted on the opening portion 56 of the first front chamber 54 and the opening portion 57 of the second front chamber 55. A reference numeral 62 denotes a connection part that connects the canister 5 side to the fuel tank 1 side with the bypass valve 12 open when the leak check is made.

Next, the operation will be described.

First, when an engine (not shown) is started, a negative pressure is generated in the intake manifold 3 of the engine (not shown). During the operation of the engine (not shown), the atmosphere is passed by the introduction of the negative pressure in the intake manifold 3 from the atmosphere communication pipe 47 of the rear chamber 46 through the air filter 8, the middle chamber 29, the second container 23, the gap 22, the first container 21 and the first front chamber 54 to separate the evaporated fuel absorbed and held by the absorbent (activated carbon or the like) 24 in the canister 5, thereby cleaning the absorbent (activated carbon or the like) 24, and supplies the separated evaporated fuel to the intake manifold 3 side of the engine (not shown) from the connection part 28 via the purge solenoid valve 4.

Next, immediately after the engine (not shown) is stopped, the temperature in the fuel tank 1 remains high and the fuel actively evaporates, so the evaporated fuel is temporarily absorbed and held by the absorbent (activated carbon or the like) in the canister 5.

Next, when the leak check is made, the engine is in a state of normal running and the intake manifold 3 is at negative pressure, so that the canister vent solenoid valve 7 disposed on the atmosphere side of the canister 5 is closed and the negative pressure is introduced from the intake manifold 3 side and is kept. At this time, the bypass solenoid valve 12 is opened to reduce the pressure of the whole system to the negative pressure. In the case where the negative pressure is kept, it is decided that a leak does not occur, but when the pressure increases it is decided that the leak does occur at some point through the system to be closed tightly.

As described above, according to the present embodiment 2, the respective constituent elements surrounded by the broken line B in FIG. 1, that is, the canister 5, the pressure sensor 6, the canister vent solenoid valve 7, the air filter 8, the one-way valve 9, the two-way valve 10 and the bypass solenoid valve 12 are integrated into one module without connecting pipes, so that the mounting work can be finished only by mounting the module described above on the vehicle. Thus, it is possible to simplify the mounting work of the respective constituent elements on the vehicle and to fundamentally prevent the problem in the prior art, that is, to fundamentally prevent the evaporated fuel from adhering to the inside of the rubber parts for connecting the respective parts described above to the pipes and from passing little by little through the rubber parts from the inside to the atmosphere.

According to the present embodiment 2, the cover 60 for covering the opening portion 56 of the first front chamber 54 and the opening portion 57 of the second front chamber 55 and the connector 59 of the bypass solenoid valve 12 are integrally molded, so that it is possible to perform the work of mounting the cover 60 and the work of connecting the connector 59 to the terminal 61 for supplying electric power at the same time. This can simplify the works.

Incidentally, needles to say, the modifications 1 to 6 of the embodiment 1 can be applied to the present embodiment 2 and can produce the same effects. For example, the example in which the full molding part in the modification 6 is applied to the bypass solenoid valve 12 in the embodiment 2 will be described in the following modification 1.

Modification 1 of the Embodiment 2

Figure 12:
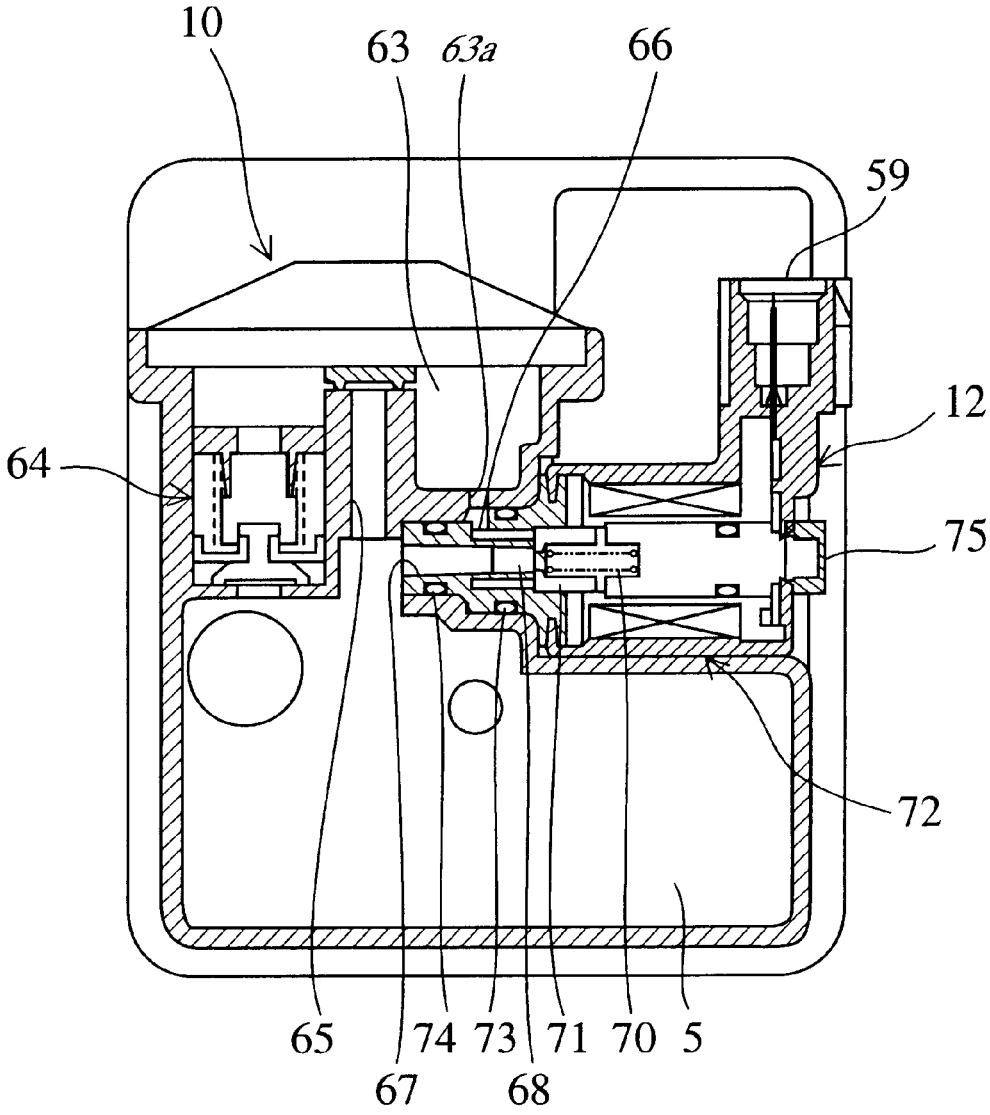
FIG. 12 is a cross-sectional view to show a modification 1 of the embodiment 2 of the evaporated fuel treating system in accordance with the present invention.

In FIG. 12 is shown a unit U3 in which the two-way valve 10 and the bypass solenoid valve 12 are integrally molded and in which the opening portion of the space is covered into which the third box-shaped space and the fourth box-shaped space are integrated. The two-way valve 10 in the unit U3 is mainly constituted by an inner space 63, a check valve 64 opened and closed by the pressure difference between the inner space 63 and the canister 5, and a diaphragm (not shown) for opening and closing a communication passage 65 for making the inner space 63 communicate with the canister 5. The diaphragm (not shown), when the fuel tank 1 side is at large positive pressure, makes the inner space 63 communicate with the canister 5 to return the pressure to the atmosphere side. Further, the check valve 64, when the fuel tank 1 side is at the negative pressure, makes the inner space 63 communicate with the canister 5 to return the pressure to the atmosphere side. Further, the bypass solenoid valve 12, when the leak check is made, makes the fuel tank 1 side communicate with the canister 5 by a control signal from a control device (not shown). Here, to the inner space 63 is connected a connection passage (not shown) connected to the fuel tank 1.

The bypass solenoid valve 12 in the unit U3 is mainly constituted by a valve body 71 that shuts a communication chamber 68 having the first opening portion 66 communicating with the opening portion 63*a* of the inner space 63 and the second opening portion 67 communicating with the canister 5 by the urging force of a spring 70 and a magnetic drive part 72 that, in the case where the two-way valve 10 is closed when the leak check is made, moves the valve body 71 against the urging force of the spring 70 described above to subject the whole connection pipe 2 to the leak check. Here, reference numerals 73 and 74 denote O-rings mounted on the outer peripheral portion of the bypass solenoid valve 12 so as to close the gap between the two-way valve 10 and the canister 5 and a reference numeral 75 denotes a sealing member that is made of resin or the like and seals the gap in the bypass solenoid valve 12.

According to this configuration, covering the opening portion of the space into which the third box-shaped space and the fourth box-shaped space in the unit U3 are integrated eliminates the need for providing individual covering members for closing the opening portions of the third box-shaped space and the fourth box-shaped space and thus can reduce the number of parts and manufacturing costs.

According to this configuration, full molding the bypass solenoid valve 12 as shown in FIG. 12 can eliminate the plating itself of the metal parts of the bypass solenoid valve 12 or subject the metal parts to an inexpensive plating.

According to this configuration, potting the connector 59 is not required, which can simplify the mounting work and improve maintainability.

Modification 2 of the Embodiment 2

Figure 13:
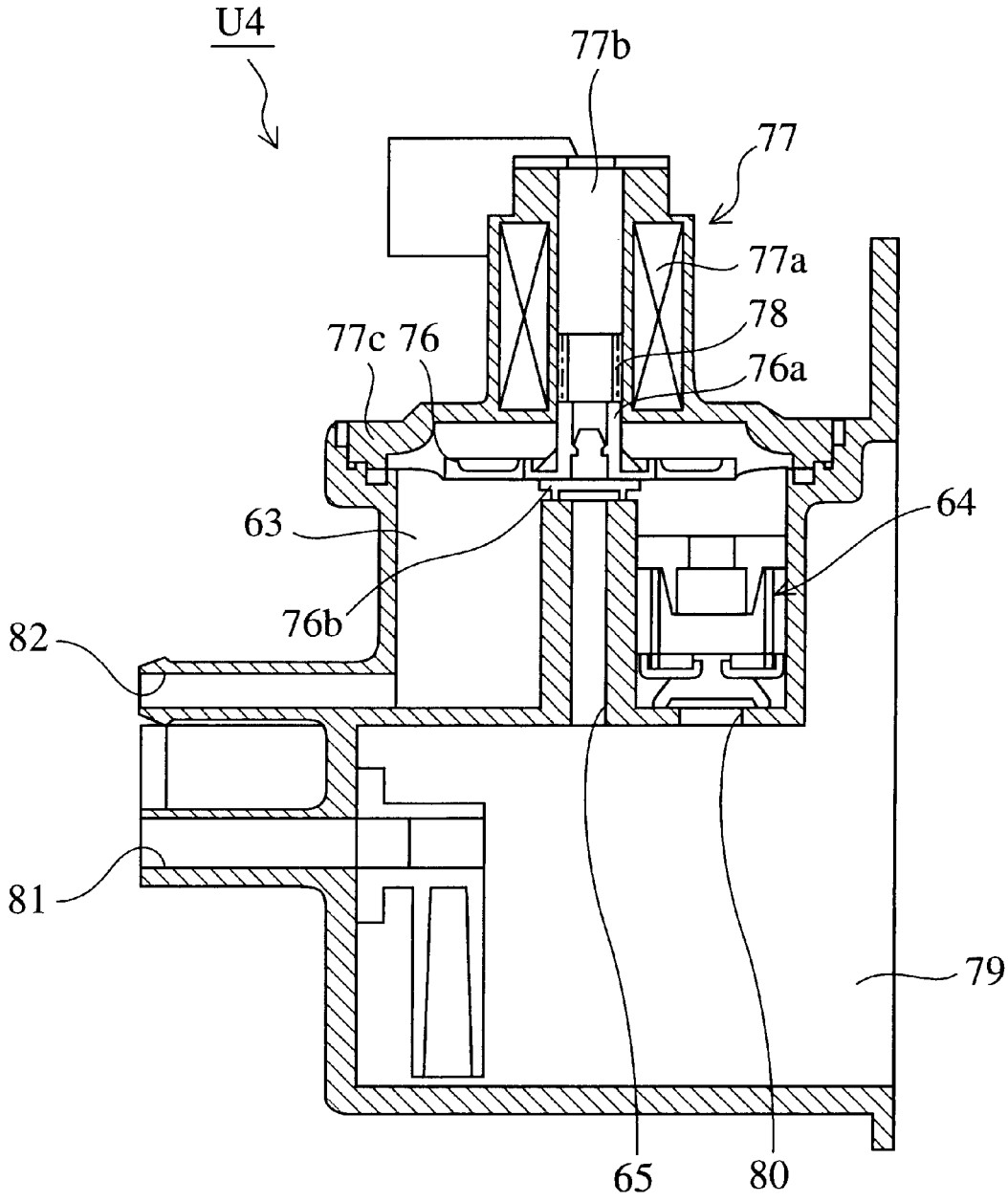
FIG. 13 is a cross-sectional view to show a modification 2 of the embodiment 2 of the evaporated fuel treating system in accordance with the present invention.

In FIG. 13 is shown a unit U4 in which the two-way valve 10 and the bypass solenoid valve 12 are integrally molded and in which the diaphragm 76 of the two-way valve 10 can be driven by a solenoid 77.

The unit U4 is provided with a spring 78 for giving an urging force to the diaphragm 76 to close a communication passage 65. When the pressure of the fuel tank 1 side is positive pressure, for example, 3 kPa or more, the diaphragm 76 is separated from the communication passage 65 by the positive pressure against the urging force of the spring 78 to make the inner space 63 communicate with the canister 5. Further, the check valve 64 is opened by the negative pressure on the fuel tank 1 side, for example, 1 kPa to make the inner space 63 communicate with the canister 5. Still further, the diaphragm 76 can be opened by the solenoid 77 irrespective of the pressure of the fuel tank 1 when the leak check is made. Here, a reference numeral 79 denotes a communication chamber and a reference numeral 80 denotes an opening portion for making the check valve 64 communicate with the communication chamber 79. A reference numeral 81 denotes a connection part communicating with the purge solenoid vale 4. A reference numeral 82 denotes a connection part for making the inner space 63 communicate with the fuel tank 1 side.

In addition, the solenoid valve 77 has a coil part 77*a*, an iron core part 77*b*, and a peripheral part 77*c* for fixing the outside of the opening/closing diaphragm 76 to the case of the unit U4. The opening/closing diaphragm 76 is provided with a plunger 76*a* and a valve body 76*b*.

The plunger 76*a* is attracted to the iron core part 77*b* by a magnetic field generated in the coil 77*a* of the solenoid valve 77 against the urging force of the spring 78 to displace the diaphragm 76 to bring the valve body 76*b* into an open state. In other words, in this modification, the opening/closing diaphragm 76 is opened and closed by the solenoid valve 77 and further the plunger 76*a* constituting the solenoid valve 77 is mounted on the diaphragm 76 side.

In addition, after the opening/closing diaphragm 76 is mounted, the solenoid valve 77 is mounted such that the plunger 76*a* mounted on the opening/closing diaphragm 76 is fitted in the solenoid valve 77.

According to this configuration, the two-way valve 10 and the bypass valve 12 are integrally molded and the opening/closing diaphragm 76 of the two-way valve 10 is opened and closed by the solenoid 77 as the magnetic drive part of the bypass solenoid valve 12. This can eliminate the need for mounting the respective valves 10 and 12 on an individual basis and thus can simplify the mounting work and also save space.

In addition, since the plunger constituting the solenoid valve is provided on the diaphragm side, the solenoid valve can directly drive the plunger without using a transmitting member such as a rod and hence can surely operate the diaphragm. Further, since the plunger is a part of the diaphragm, the solenoid valve side is not required to have a mechanism for holding the plunger, which can simplify the solenoid valve. Still further, since the plunger is held by the diaphragm, a new mechanism for holding the plunger is not required, which can reduce the size of the whole unit.

Industrial Availability

According to the present invention, it is possible to provide an evaporated fuel treating module that can simplify the work of mounting parts, prevent fuel from passing through connection parts, and prevent the metal portions of the parts from rusting. This evaporated fuel treating module can sufficiently respond to environmental regulations such as the so-called evaporation regulation, which is going to be a global trend.

What is claimed is:

1. An evaporated fuel treating module comprising:

a canister that absorbs evaporated fuel from a fuel tank;

an air filter that is disposed on the atmosphere side of the canister and passes atmosphere for separating the evaporated fuel absorbed by the canister;

a canister vent solenoid valve that is interposed between the air filter and the canister and hermetically closes the canister at negative pressure when a leak check is made; and a one-way valve that is disposed on the atmosphere side of the canister and is in an open state when the canister is at positive pressure, wherein the canister vent solenoid valve is received in a first box-shaped space arranged adjacent to the canister on the atmosphere side of the canister;

the air filter is received in a second box-shaped space arranged adjacent to the first box-shaped space and the canister;

the canister is made to communicate with the first box-shaped space by opening portions formed in their respective wall portions and the first box-shaped space is made to communicate with the second box-shaped space by opening portions formed in their respective wall portions; and the one-way valve is fixed to a cover of the first box-shaped space.

2. The evaporated fuel treating module as claimed in claim 1, wherein the cover of the first box-shaped space and a power supply connector of the canister vent solenoid valve are integrally molded, wherein the canister vent solenoid valve is received in the first box-shaped space in a state a power supply terminal of the canister vent solenoid valve being protruded from the opening portion of the first box-shaped space, and the cover is mounted on the opening portion of the first box-shaped space in a state the power supply connector being connected to the power supply terminal.

3. The evaporated fuel treating module as claimed in claim 2, wherein a gap between the power supply terminal of the canister vent solenoid valve and the power supply connector integrally molded with the cover is filled with a potting material.

4. The evaporated fuel treating module as claimed in claim 2, wherein the power supply connector integrally molded with the cover is separated from the power supply terminal of the canister vent solenoid valve, and there is provided a connector terminal for connecting the power supply connector to the vicinity of the power supply terminal of the canister vent solenoid valve, one end of the connector terminal being electrically connected to the power supply terminal of the canister vent solenoid valve, the gap between them being filled with a potting material.

5. The evaporated fuel treating module as claimed in claim 1, wherein the cover of the first box-shaped space and the canister vent solenoid valve are integrally molded.

6. The evaporated fuel treating module as claimed in claim 1, wherein the cover of the first box-shaped space communicating with the canister is integrally mounted with a pressure sensor for detecting the internal pressure of the first box-shaped space.

7. The evaporated fuel treating module as claimed in claim 1, wherein the opening portion of the first box-shaped space is covered with the canister vent solenoid valve.

8. The evaporated fuel treating module as claimed in claim 1, further comprising a two-way valve disposed between the fuel tank and the canister and a bypass solenoid valve that ensures a passage between the fuel tank and the canister when the two-way valve is in a closed state, wherein the two-way valve is received in a third box-shaped space arranged adjacent to the canister on the fuel tank side of the canister, the bypass solenoid valve is received in a fourth box-shaped space arranged adjacent to the third box-shaped space and the canister, and the canister is made to communicate with the third box-shaped space by openings formed in their wall portions and the third box-shaped space is made to communicate with the fourth box-shaped space by openings formed in their wall portions.

9. The evaporated fuel treating module as claimed in claim 8, wherein a cover of the fourth box-shaped space and the power supply connector of the bypass solenoid valve are integrally molded, the bypass solenoid valve is received in the fourth box-shaped space in a state the power supply terminal of the bypass solenoid valve being protruded from the opening portion of the fourth box-shaped space, and the cover is mounted on the opening portion of the fourth box-shaped space in a state the power supply connector being connected to the power supply terminal.

10. The evaporated fuel treating module as claimed in claim 8, wherein the third box-shaped space and the fourth box-shaped space are integrated into a space and an opening portion of the integrated space is covered with the two-way valve and the bypass solenoid valve.

11. The evaporated fuel treating module as claimed in claim 8, wherein the two-way valve and the bypass solenoid valve are integrally molded and a diaphragm for opening and closing the two-way valve is opened and closed by a magnetic drive part of the bypass solenoid valve.

* * * * *